US005908172A

United States Patent [19]

Pierro et al.

[11] Patent Number: 5,908,172

[45] **Date of Patent: *Jun. 1, 1999**

[54] SPOOL FOR FIBER OPTIC MEDIA

[75] Inventors: Steven William Pierro, North Chatham; Ronald Tracy Trefzger, Malden Bridge; Leland Hubert Boyles, Oneida; James Richard Wilkinson, East Greenbush; Victor Joseph Desrosiers, Kinderhook; Robert Vincent Fazio, Valatie, all of N.Y.

[73] Assignee: Crellin, Inc., Chatham, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,761

[22] Filed: Sep. 5, 1996

Related U.S. Application Data

[63] Continuation of application No. 08/128,803, Sep. 29, 1993, abandoned, which is a continuation-in-part of application No. 08/084,424, Jun. 29, 1993, abandoned.

[51] Int. Cl.[6] ..... B65H 75/14; B65H 75/10

[52] U.S. Cl. ..... 242/609.1; 242/608.3; 242/614; 242/118.4

[58] Field of Search ..... 242/609.1, 609.2, 242/609.3, 608.3, 118.4, 613, 118.41, 614, 388.6, 407, 407.1, 613.4, 613.5

[56] References Cited

U.S. PATENT DOCUMENTS

| | | | |
|---|---|---|---|
| 3,176,932 | 4/1965 | Kovaleski | 242/609.1 |
| 3,301,503 | 1/1967 | Browning | 242/613 X |
| 4,101,095 | 7/1978 | Carter | 242/608.4 X |
| 4,387,863 | 6/1983 | Edmonston et al. | 242/118.4 |
| 4,542,862 | 9/1985 | Romike et al. | 242/614 |
| 4,667,896 | 5/1987 | Frey et al. | 242/118.41 |
| 4,880,182 | 11/1989 | Gelfman | 242/118.4 X |
| 4,917,323 | 4/1990 | Wing | 242/407 |
| 5,265,822 | 11/1993 | Shaber, Jr. et al. | 242/407 |

FOREIGN PATENT DOCUMENTS

| | | | |
|---|---|---|---|
| 663410 | 12/1951 | United Kingdom | 242/609.2 |

*Primary Examiner*—John Q. Nguyen
*Attorney, Agent, or Firm*—Kane, Dalsimer, Sullivan, Kurucz, Levy, Eisele and Richard, LLP.

[57] ABSTRACT

A spool for filamentary material such as optical fibers and others consists of two members which are locked together to form a drum with two opposed flanges defining a winding space. The two members may be separated to allow material wound on the drum to be removed at will. After the material is removed, the two parts may be locked again making the spool reusable.

4 Claims, 15 Drawing Sheets

310
326
330
312
325
324
327
328
332
336
334
314
324'
330'
332'
328'
318
394
316
362
322
371
346
21
122
340
342'
366
21
122
344
350'
336'
360
364
338
338'
367
356
358'
26
350
342
320
372
380
378
340'
346'
366
344'
352
384
374
370
26
386
376
382
354
342'
350'
344
340
346

SPOOL FOR FIBER OPTIC MEDIA

This application is a continuation of application Ser. No. 08/128,803, filed Sep. 29, 1993, now abandoned, which is a continuation-in-part of application Ser. No. 08/084,424, filed Jun. 29, 1993, now abandoned.

BACKGROUND OF THE INVENTION a. Field of Invention

This invention pertains to a spool for holding wires, cables or optical fibers, and more specifically to a spool which can be separated at will into two parts.

b. Description of the Prior Art

Filamentary materials such as wires, cables, optical fibers, are kept for ease of handling on a spool consisting of a tubular drum having two opposed ends and two flanges affixed to said barrel at the respective ends and extending radially outwardly therefrom. One end of the elongated material is secured on the drum and the elongated material is then wound thereon. Once the spool has been transported to the cabling site, the material is paid off from the spool until a preselected length has been reached.

A problem with existing spools relates to the manner in which remainders are removed. The elongated material is provided in various lengths which normally exceed the amount of material actually required. For example, while a spool may hold 110 km of opitical cable, of which only a 100 km of optical fiber may be actually required. After a desired amount of material, for example about 100 km, is removed from the spool the remainder (i.e. about 10 km) is usually too short for most applications and must be discarded. However, this remainder must still be removed from the spool if the spool is to be reused. In prior art spools, the remainders could be removed by paying it off the spool, a very time consuming operation. Moreover, this was also unsatisfactory because, it may require equipment which may be used more efficiently elsewhere, and results in a length of unwound material which is difficult to handle. More frequently the remainder was simply cut off, however it was almost impossible to cut each strand or coil without damaging the barrel, especially if a relatively thin material is involved, such as an optical fiber.

OBJECTIVES AND SUMMARY OF THE INVENTION

An objective of the present invention is to provide a spool for winding filamentary material, wherein said material is separable into two pieces to permit the removal of remainders from the spool.

Another objective is to provide a spool made of two pieces, said pieces being identical for ease of replacement.

A further objective is to provide a spool which may be made by a single cavity injection molding.

Other objectives and advantages of the invention shall become apparent from the following description. Briefly, a spool for filamentary materials particularly optical fibers, consists of a drum and two flanges disposed at the axial ends of the drum to define a toroidal winding space. The spool is made preferably of two identical members, each having a cylindrical wall and one flange, the members being formed so that when they are placed in an abutting relationship, the cylindrical surfaces form the drum. Interlocking means are used to selectively secure the two members together. The flanges may be tapered or perpendicular to the barrel. The interlocking means may be disengaged to allow the two members to separate for removal of the material wound thereon. A resilient sleeve may be mounted on the drum for the protection of the wound material.

DETAILED DESCRIPTION OF THE INVENTION

Figure 1:
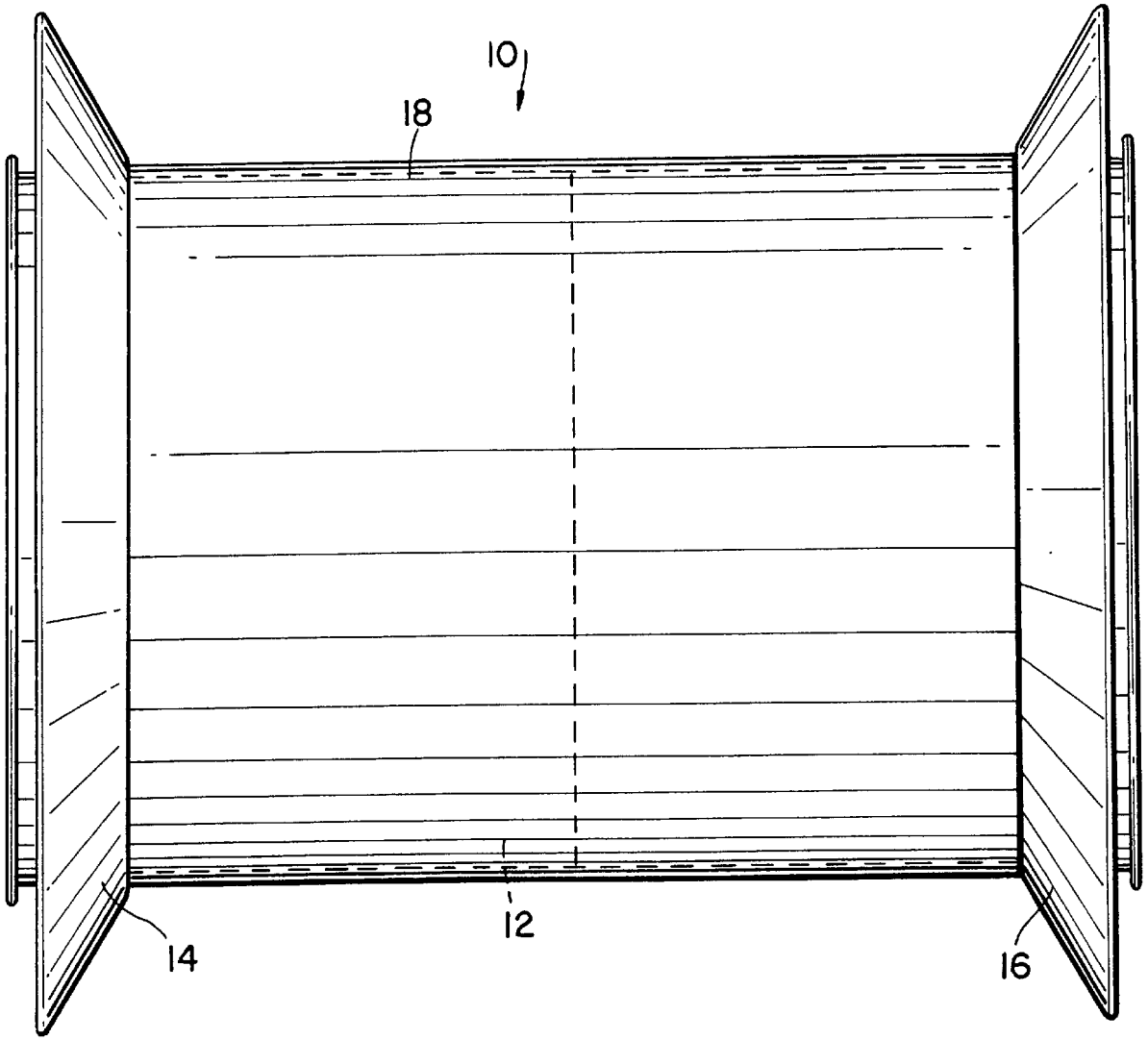
FIG. 1 shows a side elevational view of a spool constructed in accordance with this invention.

Referring now to the drawings, a spool 10 constructed in accordance with this invention consists of a cylindrical drum 12 and two frustoconical flanges 14, 16 disposed coaxially with the drum 12 as shown. The drum 12 may be optionally covered with a sleeve 18 made of a resilient material such as a polyethylene foam. This material is commercially available in various sizes which can be cut to a rectangular sheet and its ends can be joined by solvent welding or other means to form the sleeve commercial. The spool is made of a high impact plastic material such as polystyrene or abs, preferably by injection molding using a single cavity injection mold.

Figure 2:
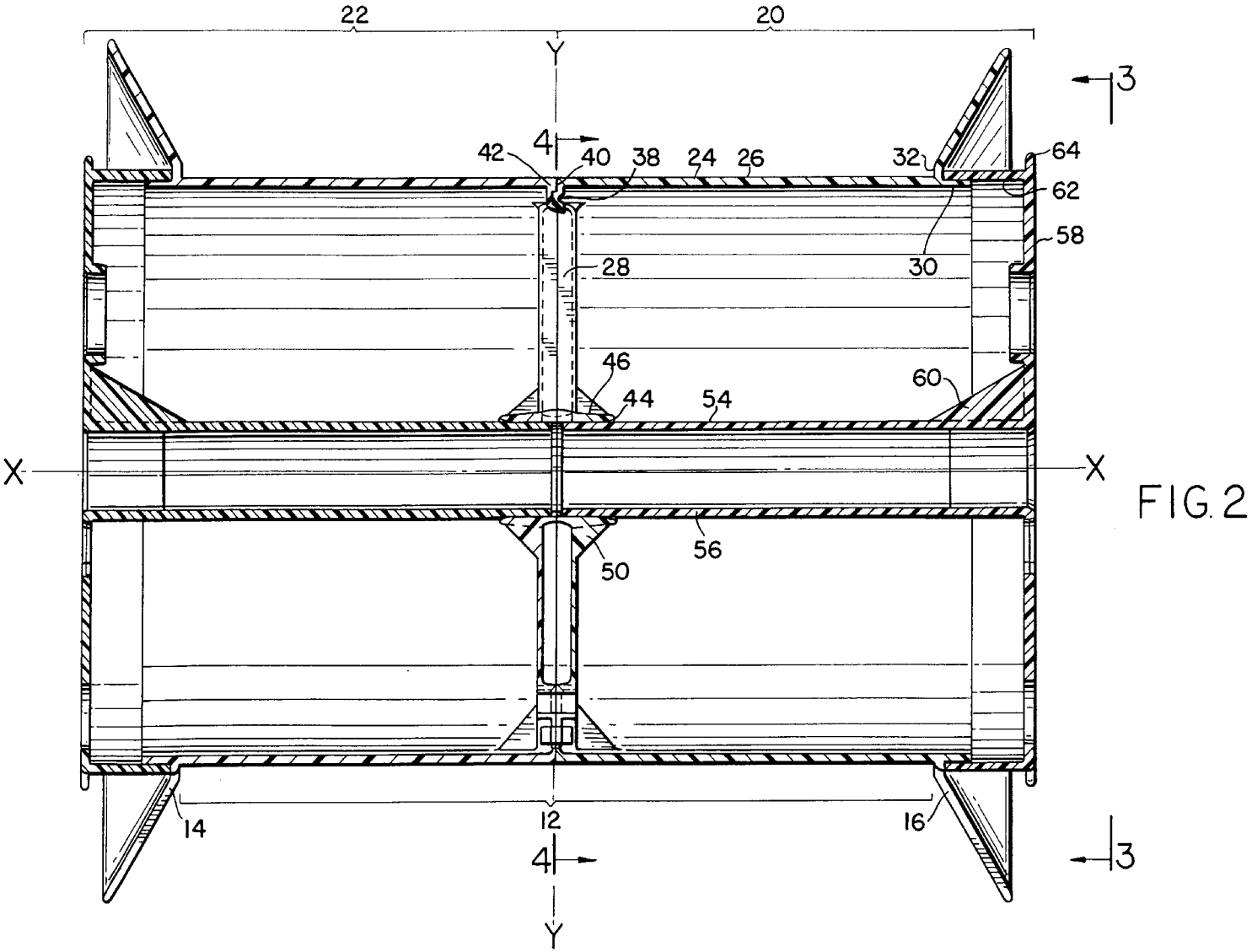
FIG. 2 shows a cross-sectional view of the spool taken along line 2—2 in FIG. 3 with the protective sleeve omitted.
Figure 3:
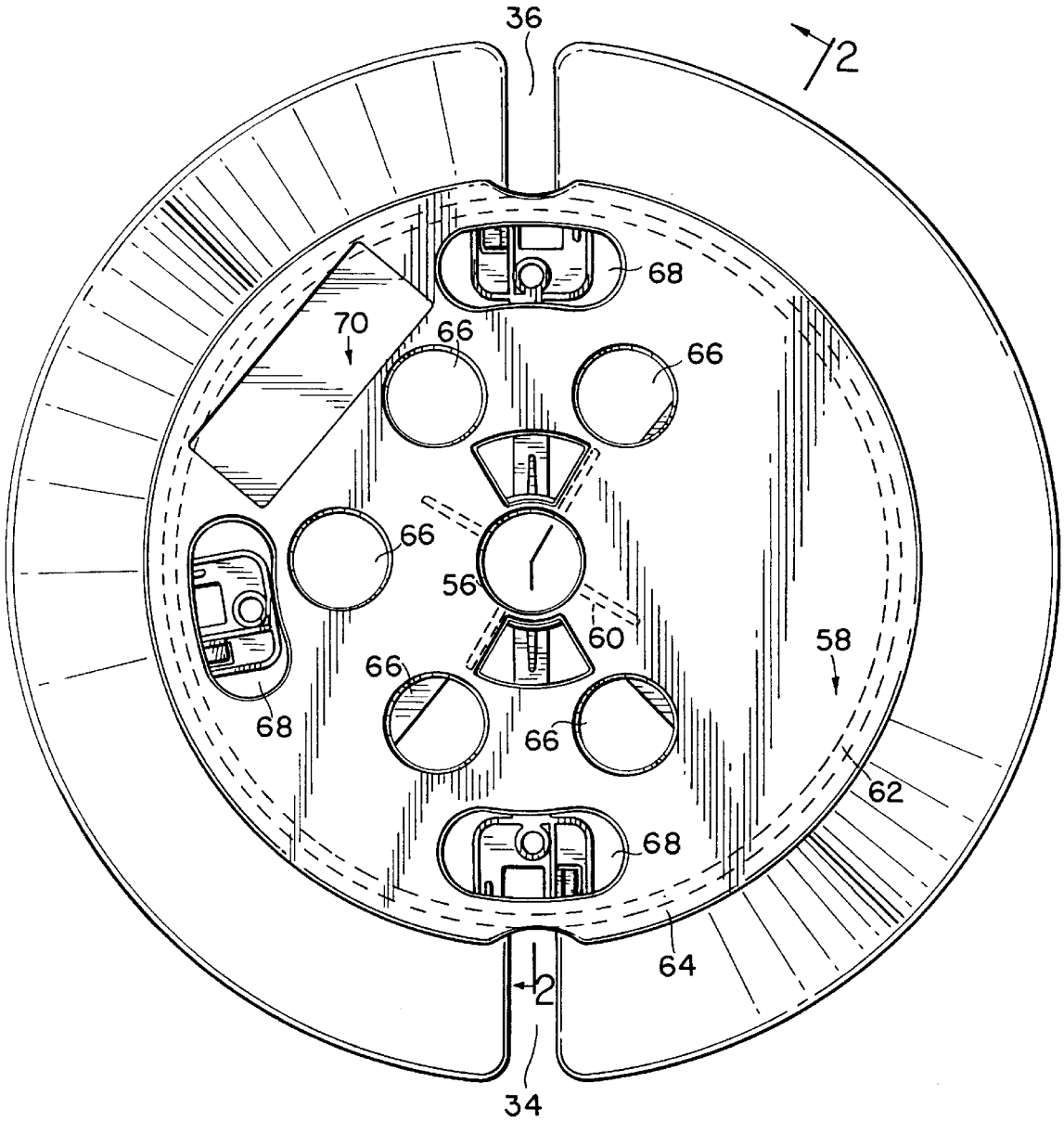
FIG. 3 shows an end view of the spool of FIG. 2.
Figure 4:
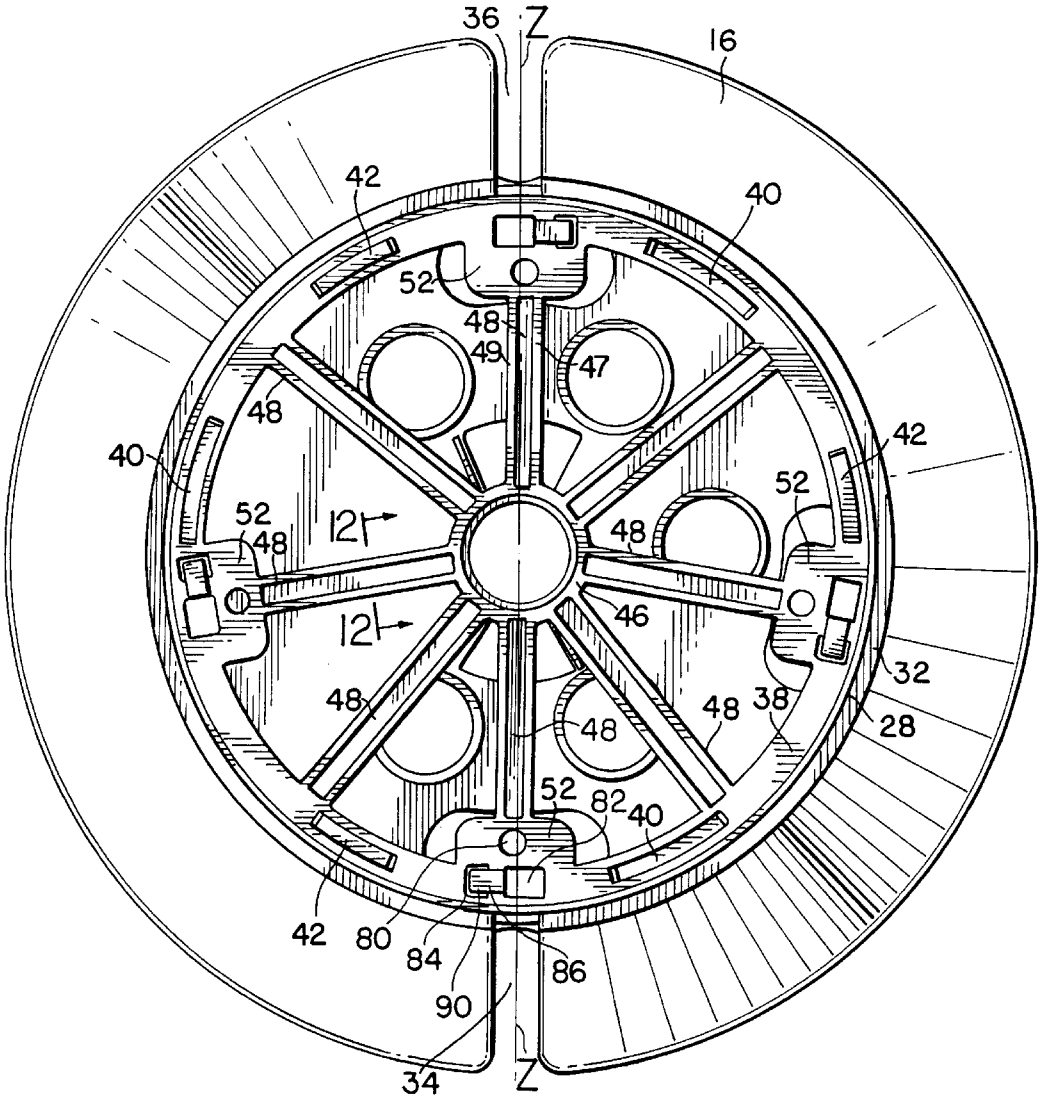
FIG. 4 show an end view of a spool member for the spool of FIGS. 2–3.

As best seen in FIG. 2, the spool 10 is made of two identical members 20, 22 joined as described in more detail along a plane Y-Y normal to the longitudinal axis X-X of the spool 10. Member 20 consists of an outer section 24 and a central section 54. Outer section 24 includes a cylindrical wall 26 which forms one half of the drum 12 and terminating on the left side with a circular end piece 28. Opposite piece 28, wall 26 is terminated by flange 16 and an axially extending circular lip 30. Preferably a small portion 32 of flange 16 extends radially outwardly of wall 26 before the flange starts angling axially. The radial dimension of this portion 32 is equal in length to the thickness of sleeve 18. As seen in FIGS. 3 and 4 flange 16 has two diametrically opposed rectangular slots 34, 36.

Figure 12:
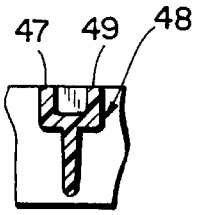
FIG. 12 shows a cross sectional view of a spoke for the spool members taken along line 12—12 in FIG. 4.

Details of end piece 28 are shown in FIG. 4. It consists of a circular outer rim 38. This rim 38 is formed with a plurality of arcuate depressions 40 alternating with arcuate raised areas or teeth 42. Radially inwardly of rim 38 is a central hub 46 having the shape of a cylindrical sleeve extending axially as shown in FIG. 2. Hub 46 is connected to rim 38 by a plurality of radial spokes 48. As best seen in FIG. 2, the hub 46 is connected to each of the spokes 48 by a triangular wall 50 for reinforcement. Preferably, the spokes are not equidistant from each other but instead they are separated by angles ranging from 30° to 60°. However, the spokes are symmetrically arranged with respect to a vertical axis Z-Z passing through the two flange slots 34, 36. The spokes have a generally Y-shaped cross-section, with the two arms 47, 49 of the Y being shown in FIG. 12. Four of the spokes are provided with an enlarged D-shaped land area 52 used for interlocking the spool members 20, 22 as described below.

The central section 54 (FIG. 2) consists of a hollow shaft 56 terminated on the right side with a circular end 58. A plurality of triangular walls 60 are used to brace the shaft 56 against end 58. At its outer perimeter, end 58 is provided with a cylindrical section 62 extending coaxially with shaft 56. A portion of end 58 extend radially outwardly of wall 62 to form a small flange 64. As seen in FIG. 3, end 58 is formed with a plurality of circular holes 66 as well as three oval holes 68, all the holes 66, 68 being disposed about sleeve 56. A shallow rectangular area 70 on end 58 is provided for holding a label identifying the spool and/or its contents.

The two sections 24, 54 are made separately using single cavity molding techniques. To assemble the two sections 24, 54, the shaft 56 is axially inserted into the hub 44, while at the same time cylindrical section 62 slides telescopically over lip 30 until it reaches the section 32 of flange 16. In this position, the shaft 56 is joined to the hub 44 and wall 62 is joined to lip 30 by using any well known means such as by solvent welding or the use of an adhesive.

Figure 5:
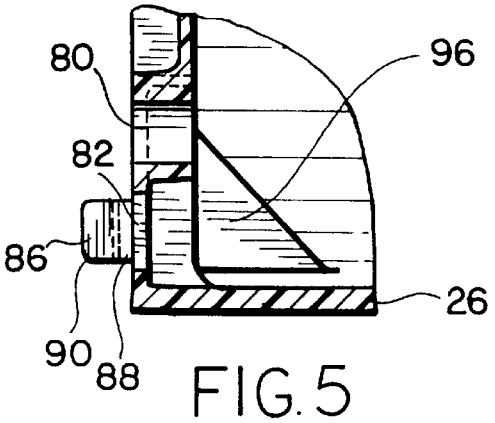
FIG. 5 shows a partial sectional view of the interlock for the spool of FIGS. 1–4.

Referring now to FIGS. 5–8, D-shaped land area 52 is formed with a circular hole 80 disposed in the vicinity of an end of spoke 48. Underneath hole 80, as viewed in FIG. 5, there is a generally rectangular hole 82. To the left of hole 82 is a slightly smaller rectangular hole 84. In the view of FIG. 5, hole 84 is partially covered by an L-shaped tongue 86 (FIG. 5) having a first section 88 extending normally away from land area 52 and a second section 90 extending in parallel to land area 52 and connected to one end to section 88. The opposite end of section 90 is tapered as at 92. In addition, one side of section 90 is formed with slight groove 94 (FIGS. 6A). As shown in FIG. 6A, land area 52 is reinforced by two braces 96, 98 extending to and are integral with cylindrical wall 26. On the right side of hole 82, as seen in FIGS. 6A and 6B, there is a boss 100 extending axially inwardly into member 52 in a direction opposite to tongue 86. Boss 100 has a cross sectional shape which is at least partially complementary to groove 94.

Figure 6A:
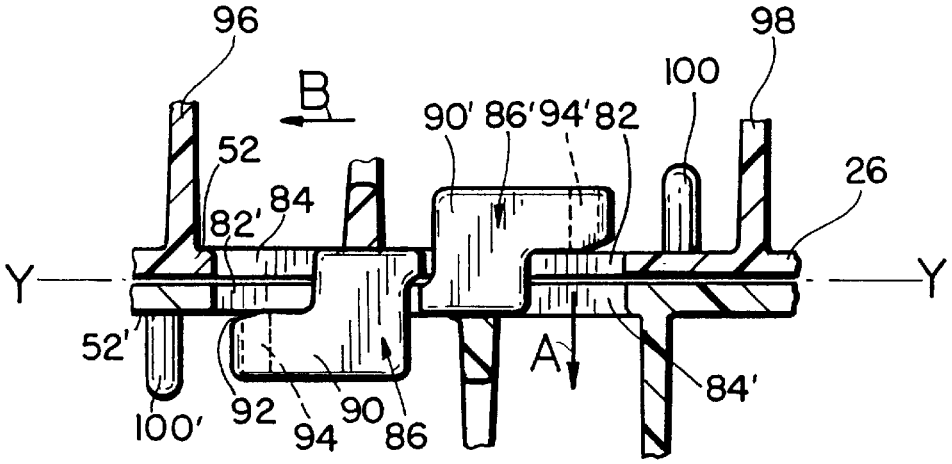
FIGS. 6A and 6B show an enlarged view of two spool members before and after engagement respectively.
Figure 6B:
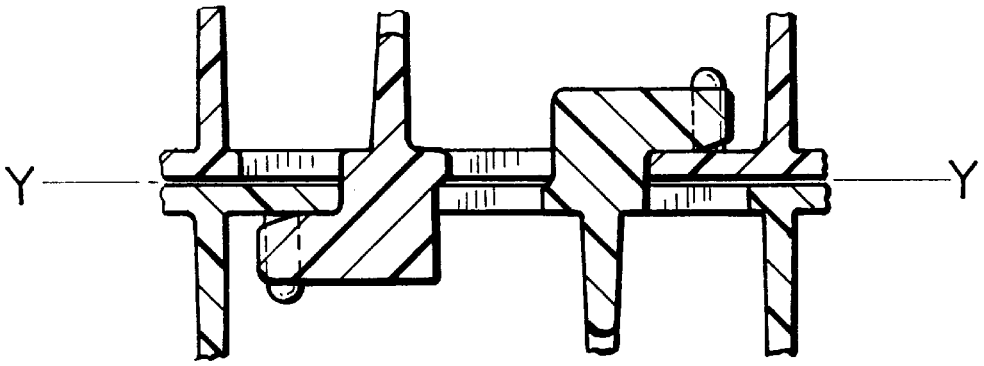
Figure 10:
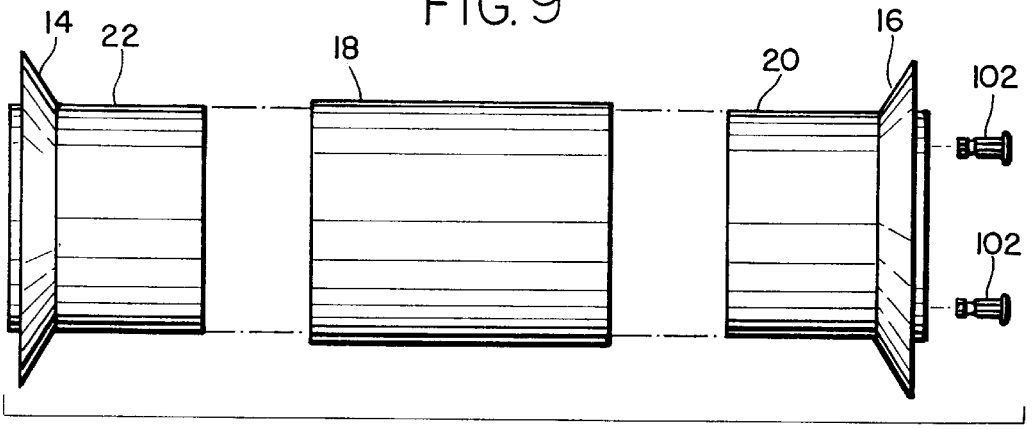
FIG. 10 shows an exploded view of the spool.

As previously mentioned members 20 and 22 are preferably substantially identical. Referring to FIG. 10, the spool 10 is assembled as follows. First sleeve 18 is inserted over member 22. Next, member 20 is inserted into sleeve 18 until it abuts member 22 and the two members are then engaged to each other to form the spool 10. For this purpose the two members are held in an interengaged position by the components of the land areas on the abutting end pieces as shown in detail in FIGS. 6A and 6B. In FIGS. 6A and 6B for the sake of clarity the elements of member 22 are identified by a prime symbol (') to differentiate them from the identical elements of member 20.

The two members 20, 22 are engaged by first positioned side by side so that their hubs are aligned along common axis X-X and the spokes 48 of member 22 are disposed adjacent to each other and offset angularly by a small angle to permit the tongue of one member to enter into the rectangular holes of the other member by advancing one of the members toward the other along said common axis until the two end pieces are in contact with each other. In this configuration, the teeth 42 of one member (FIG. 4) are inserted into the corresponding depressions 40 of the other member. The depressions are slightly longer 40 than the teeth 42 to allow the members 20, 22 to turn with respect to each other by a small angle. In FIG. 6A, tongue 86 has been advanced in direction indicated by arrow A so that its section 90 has passed through hole 82'. At the same time tongue 86' is slipped into hole 82 as shown. Next, the two members 20, 22 are rotated with respect to each other about axis X-X to cause the spokes of the members to be precisely aligned with each other. This rotation causes the land area 52 to move with respect to land area 52' in the direction B in FIG. 6A. As a result, section 90 of tongue 86 moves behind area 52' until its groove 94 snaps into engagement with boss 100', as shown in FIG. 8B. Similarly hole 82 moves to engage tongue 86'. The final position of the tongues can be seen through holes 68 in FIG. 3. Since there are at least three land areas 52 disposed angularly about the hub 56, the two members 20, 22 are solidly interengaged against both axial and radial forces.

Figure 7:
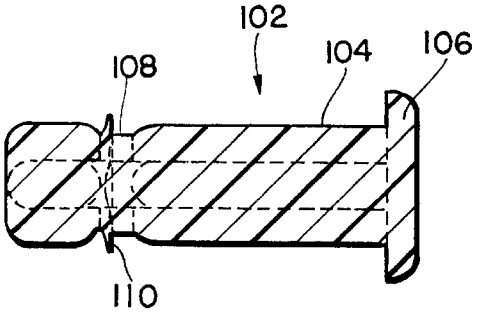
FIGS. 7 and 8 show a sectional view and an end view respectively of a locking pin for the spool of FIG. 2.
Figure 8:
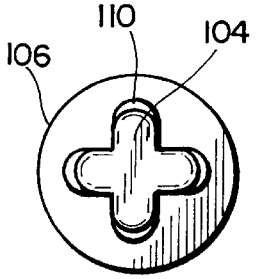
Figure 9:
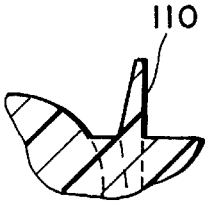
FIG. 9 shows a blown-up detail of the pin of FIG. 7.

However, the spool 10 may be subjected to severe shaking especially if it is dropped, which may cause its members to separate. In order to prevent such an inadvertent separation, the spool may be provided with locking pins, such as locking pin 102 shown in FIGS. 7 and 8. Pin 102 is formed of a body 104 which is preferably fluted so that it forms an X-shaped cross section as seen in FIG. 8. At one end, a round head 106 is attached to the body, said head having an outer diameter larger than the inner diameter of hole 80 (FIG. 4). Adjacent to its free end, body 104 is formed with a circumferential groove 108. Extending radially outwardly of groove 108 are a plurality of fins 110. As seen in FIGS. 7 and 8, the fins extend radially outwardly of body 104.

After the two members 20, 22 are interengaged, as discussed above, at least two pins 102 are introduced into the member 20 through holes 68 and then inserted through holes 80. The distance between fins 110 and head 106 is equal to the thickness of the land areas 52, 52' so that as body 104 passes through the holes of the end pieces, the fins 110 first bend radially inwardly and then when they are through, they snap outwardly to maintain the pins in place. The pins 102 prevent the members 20, 22 from turning with respect to each other and hence insure that they remain interengaged until the pins 102 are removed.

Figure 11:
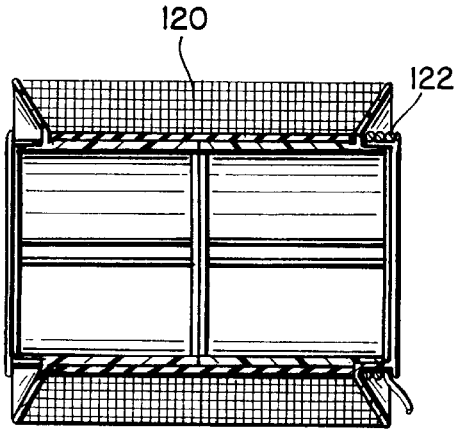
FIG. 11 shows the spool of FIG. 1 wound with a filamentary material.

After the spool 10 has been assembled, a filamentary material is wound on it as shown on FIG. 11. The main body 120 of the material is wound between the flanges 14, 16 as shown. However, for some materials, such as for example optical fibers, both ends of the material must be accessible for testing. For these types of material, the inner end 122 of the material is first wound on the cylindrical wall 62 which forms a secondary winding surface disposed between the main flange 16 and auxiliary flange 64, shown in detail FIG. 2. After a predetermined length of material (for example about 10 m for an optical fiber) is on wall 62, the material is past through slot 34 or 36 and is then wound on sleeve 18 until the spool is full as shown in FIG. 11. As described above, the spool is constructed and arranged so that the wall 62 and the outer surface of the sleeve 18 are substantially even to insure that the filamentary material winds properly on the spool without any bends.

The spool with the wound material is transported to the cabling site where a predetermined amount of material is removed therefrom. If the remainder left on the spool is unusable, or if the remainder must be removed for any other reason, the two spool members are easily separated by removing pins 102 and turning one of the spool members until the two spool members are disengaged. The spool members are then separated and the remainder is removed in a neat and manageable coil. This remainder coil is discarded or put to other use, while the spool can be reassembled and shipped back to a manufacturing facility to be reused.

The present invention has a certain features which are particularly advantageous, especially for optical fibers. Preferably the spool 10 is made of plastic material which has a thermal expansion coefficient usually larger than the coefficient of some of the material to be wound i.e., the coefficient of optical fibers. Therefore if the material is wound directly ont the drums, a rise in the ambient temperature causes the spool body expands more than the material wound thereon which in turn may damage the optical fiber by changing its index of refraction. The sleeve 18 being resilient absorbs the expansion of the drum thereby preventing damage to the material. In addition, the sleeve cushions the wound material from shocks and vibrations. Finally, the sleeve prevents the material from sliding on the drum as it is being wound or transported. The sleeve 18 is made of a relatively inexpensive material so that if it is damaged, it is easily replaced. Of course for some filamentary material the sleeve may be omitted. Similarly, since the two spool members are identical, they can be easily manufactured and if one is damaged, it is readily replaceable.

Figure 13:
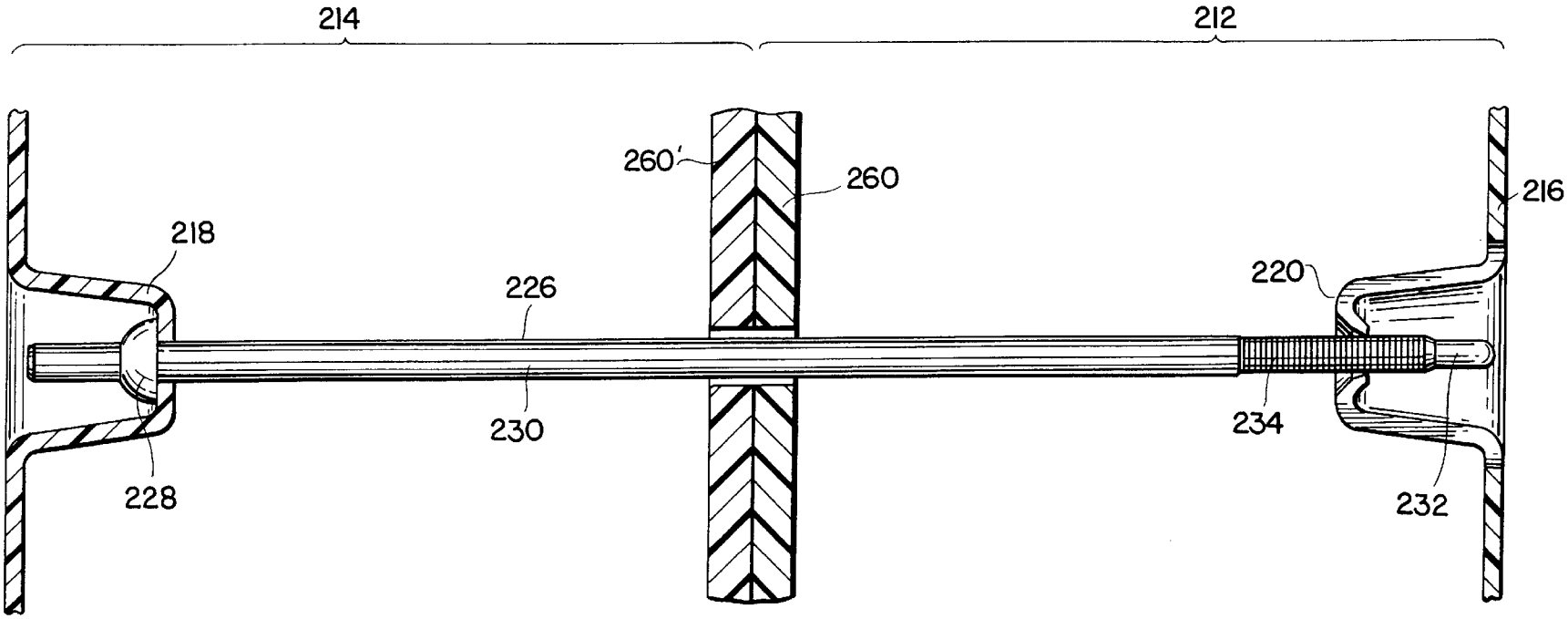
FIG. 13 is a partial cross sectional view of a second embodiment of the invention.
Figure 15:
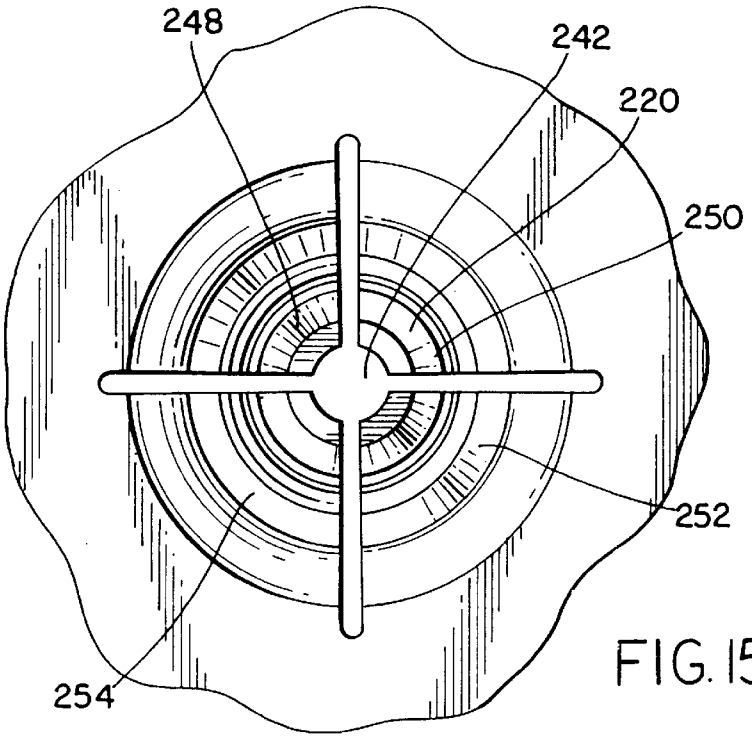
FIG. 15 shows a partial right end view for the spool of FIGS. 13 and 14 without the connecting pin.

FIGS. 13–18 show a second embodiment of the invention. In this embodiment, spool 210 is formed of two members 212, 214 similar to members 20, 22 except for the land areas 52. Instead, member 212 is formed at the outer end 216 with four wells 218, 220, 222, 224, shown in FIG. 18. Member 214 is identical in shape to member 212 and is arranged so that its well 218' is lined with well 220 as shown in FIG. 13. Extending between these two members 212, 214 are four pins 226 one of which is shown in FIGS. 13–17. Pin 226 includes a head 228, a shaft 230 and a distal end 232 formed with a plurality of peripheral grooves 234.

Figure 14:
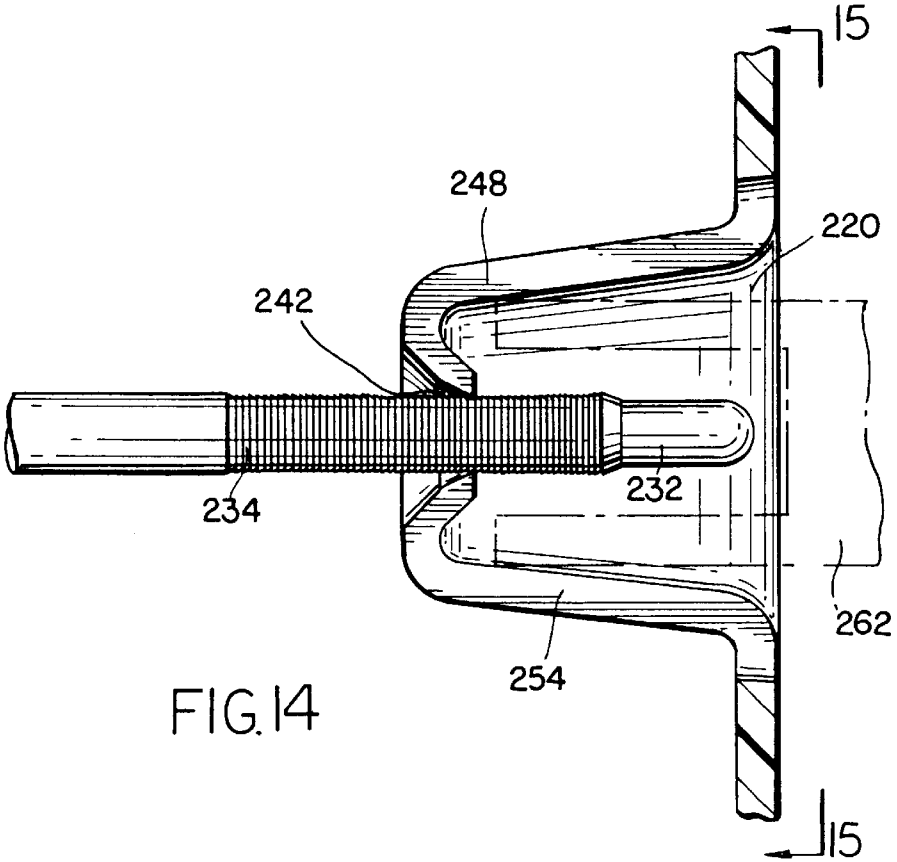
FIG. 14 shows one enlarged view of the right side of the embodiment of FIG. 13.
Figure 17:
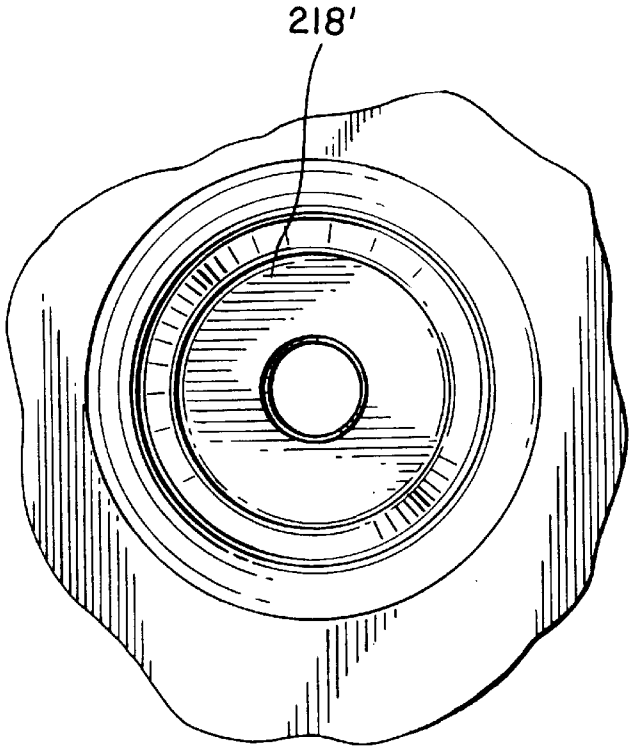
FIG. 17 shows a partial left end view of the embodiment of FIGS. 13 and 16 without the connecting pin.
Figure 16:
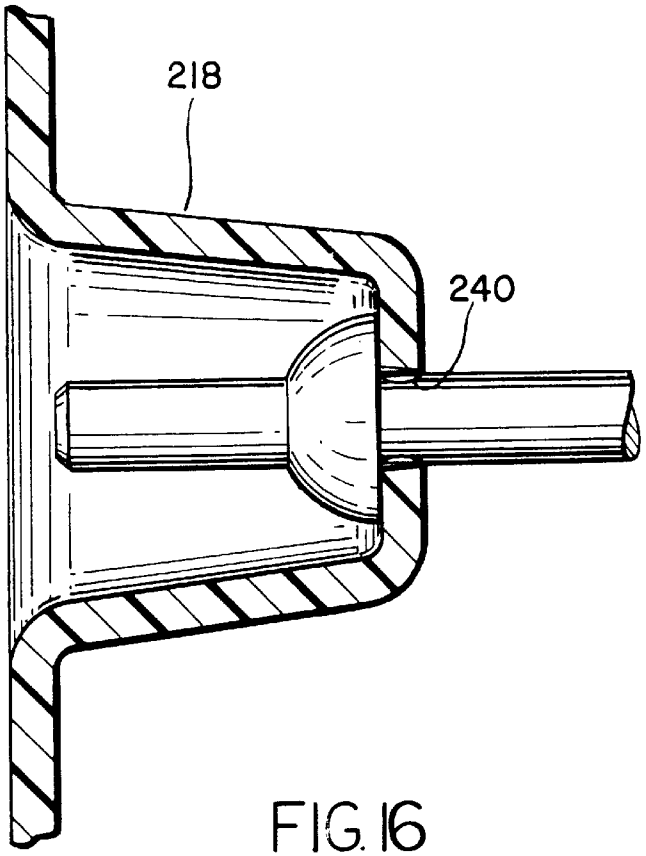
FIG. 16 shows an enlarged view of the left side of the embodiment of FIG. 13.
Figure 18:
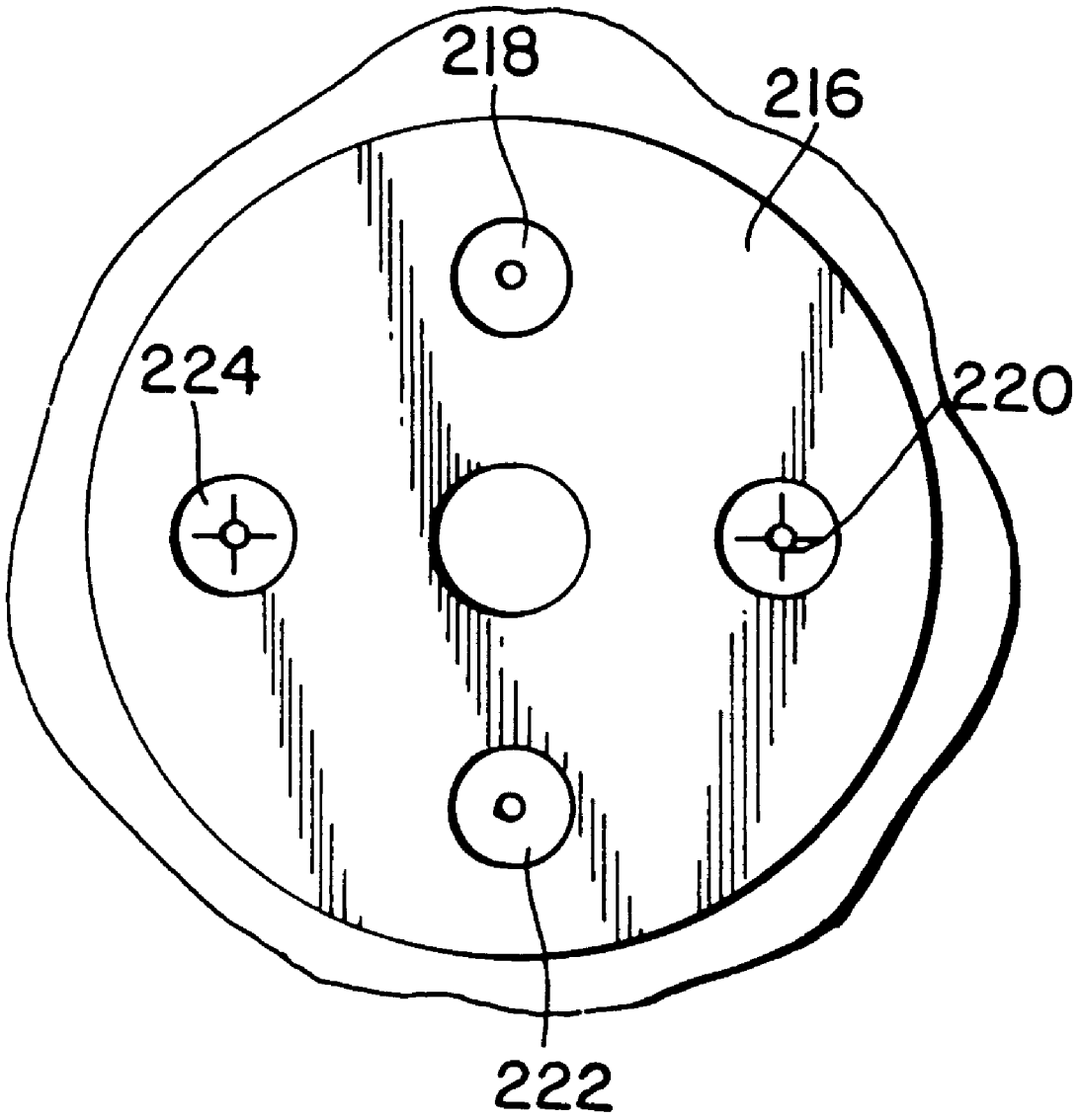
FIG. 18 shows a complete end view of the embodiment of FIG. 13.

Wells 218, 222 are provided with a circular hole 240 at their bottom which is slightly larger in diameter than shaft 230. Hole 220 is formed with a similar but slightly smaller hole 242. However, hole 242 is dissected by two perpendicular cuts 244, 246 forming a cross shaped slot in each well. The cuts in effect partition the wells into four grabbing arms 248, 250, 252, 254 extending radially toward hole 242. Well 224 is identical to well 220. As seen in FIGS. 13 and 14 these grabbing arms are constructed and arranged to engage the shaft 230 of pin 226 by forming an interference fit with grooves 230. As seen in FIG. 14, grooves 234 are angled backwards toward head 228.

Figure 19A:
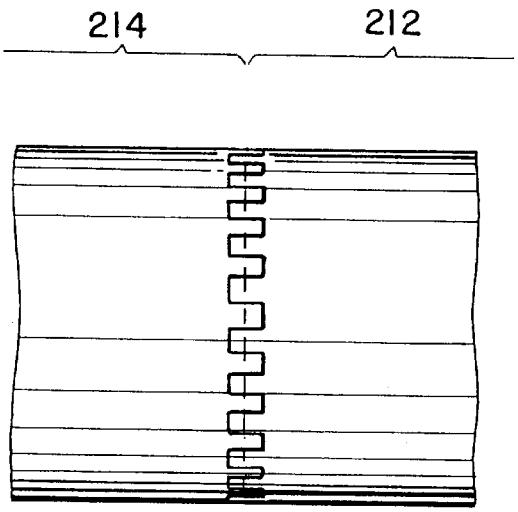
FIGS. 19A and 19B show respectively, a partial side elevational and an enlarged side elevational view of the embodiment of FIGS. 13–18.
Figure 19B:
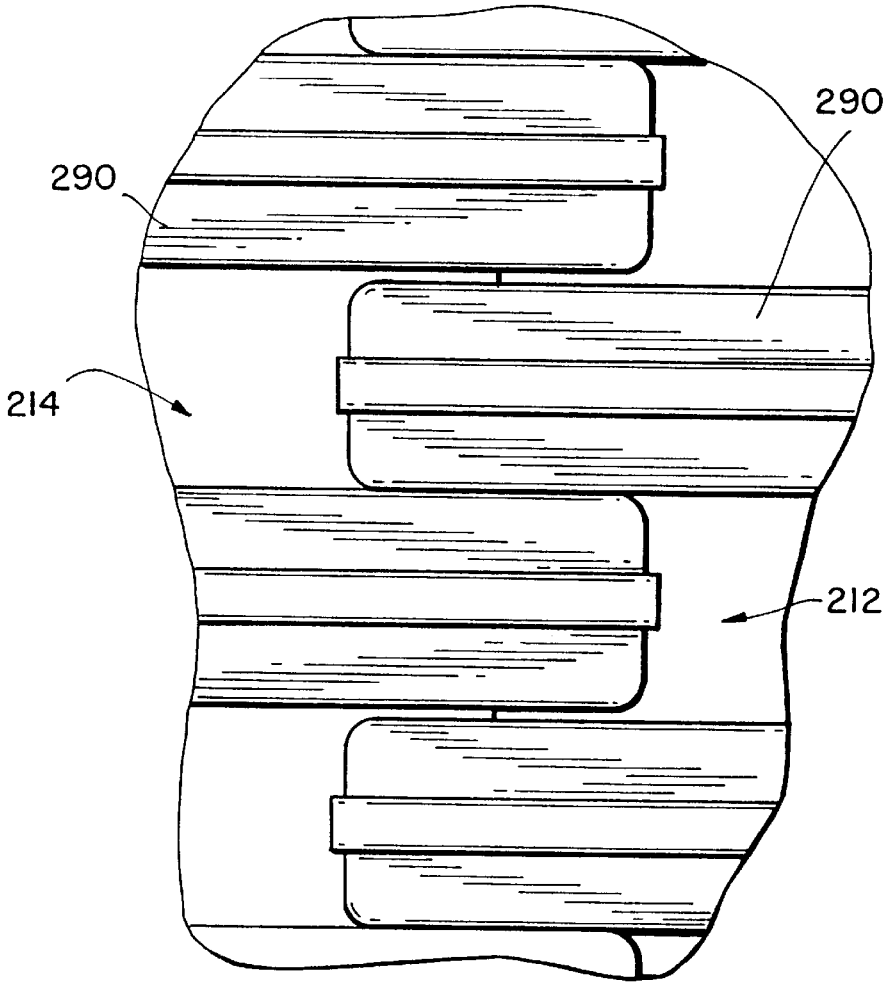

The spool 210 is assembled in a manner similar to the first embodiment. A sleeve (not shown) is first slipped over one of the members 212, 214. The other member is inserted into the sleeve until the inner ends 260, 260' are in abutting relationship. Four pins 226 are then inserted into the spool, two into holes 230 in wells 218, 222, and two into the identical holes on member 214, until the pins extend between the members with end 232 extending into one of the slotted wells. The four pins are pushed preferably with a predetermined force into the spool forcing some of the grooves 234 to pass through holes 242. After the inserting force is removed, the pins are maintained in place by the interference fit between the grabbing arms and the grooves 234 thereby biasing the two members 212, 214 against each other. In this configuration the two members 212, 214 are interlocked and the spool 210 is ready for use. The spool is separated into its component members by using a tapered tool 262 (shown in outline in FIG. 14) shaped so that as it pressed into one of the slotted wells such as 220, it separates the gripping arms 248–254 and thereby releases the pins 226 and allowing the members 212, 214 to be disengaged. After the remainder is removed, the spool 210 may be reassembled for further use. If the grooves on a pin wear out, the pin may be replaced with a new one. After a while, the tips of the arms 248–254 may wear out as well. The spool then may be used at least one more time by joining them together along inner ends 260, 260', for example by solvent welding. In order to insure that these inner ends are aligned properly they may be provided with interlocking means such as for example, complimentary tabs 290 shown in FIGS. 19A and 19B found on the walls of members 212, 214. Again, just like in the previous embodiment, the two members are identical so that their components can be made from a single cavity molding.

FIGS. 20–23 show a third embodiment of the invention. In this embodiment, a spool 310 is provided which is formed of two cup shaped members 312, 314, two caps 316, 318 for closing the cup shaped members, and a plurality of plugs such as 320 and 32:2 for securing the cup shaped members 312, 314 to each other.

Member 312 is formed of a disk-shaped wall or outer end wall 324 extending radially and having two annular lips 326, 328 extending axially to define an annular space 330. Wall 324 is reinforced with ribs 325 which may be slanted radially inwardly as at 327 to permit a fiber to be wound on lip 328 as discussed in more detail below.

Wall 324 extends radially away from a cylindrical wall 332. A circular plate or inner end wall 334 extends radially inwardly of the other end of wall 332. Wall 332 has an outer cylindrical surface 336. Of course it should be understood that walls 324, 334 and plate 336 are made simultaneously as an integral member.

Plate 334 is formed with a central cylindrical hub or inner sleeve 338 and a plurality of holes disposed around hub 338 including a first hole 340 and a second hole 342. Hole 340 is defined by an oval shoulder 344 shown in FIG. 21.

Figures 20, 21, 22:
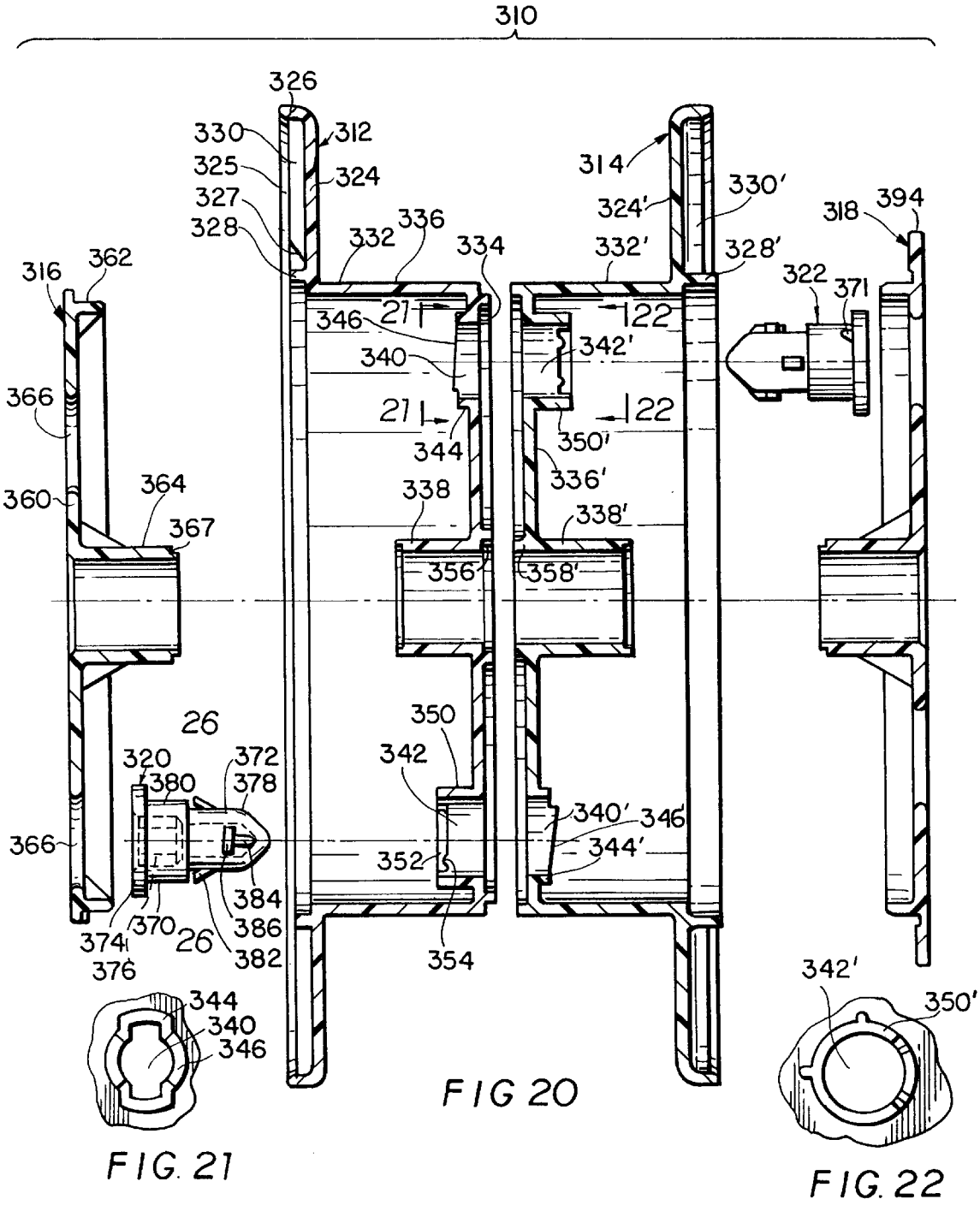
FIG. 20 shows an exploded side sectional view of third embodiment of the invention.
FIG. 21 shows a partial end view taken along line 21—21 in FIG. 20.
FIG. 22 shows another partial end view taken along line 22—22 in FIG. 20.

Preferably the edge 346 of shoulder 344 is not parallel to plate 334 but is rather slanted as shown in FIG. 20.

Hole 342 is defined by an annular shoulder 350. Shoulder 350 is formed with an internal depression 352 having at one peripheral end a stop 354.

Opposite hub 338, plate 336 is formed with a circular depression 356.

Cap 316 is formed of a circular plate 360 having a peripheral annular wall 362 and a central hub 364. Hub 364 has a narrowed portion 367. A plurality of holes 366 are formed on plate 360 matching the location of holes 340, 342.

Cap 318 has the same shape as cap 316.

Cup shaped member 314 has the same general shape as cup shaped member 312 including disk shaped wall 324', space 330', cylindrical wall 332', plate 336', hub 338', holes 340'. 342' and walls 344', 350'. One minor difference is that plate 336' has an annular rib 358' to match depression 356.

Plugs 320 and 322 are identical. Each is composed of two cylindrical portions 370 and 372 extending axially with respect to each other. Portion 370 is provided at its free end with an enlarged radial shoulder 374. Shoulder 374 is provided with a wedged shaped knob 371 best seen in FIG. 20 on plug 322. Portion 370 is also formed with a hexagonal hole 376, seen more clearly in FIG. 25. Portion 372 has an outer cylindrical wall 378 which is smaller than the wall of portion 370. On this wall 378 there are a set of flexible fingers 382. These fingers extend at an angle with respect to the axis of the plug toward portion 370 as best seen in FIG. 20. Axially outwardly of these fingers 382, portion 372 is provided with two T-shaped bosses 384. These bosses 384 have a camming surface 386. Preferably portion 372 is pointed as at 390 so that it is easier to insert into holes 340, 342 as discussed in more detail below.

Figure 23:
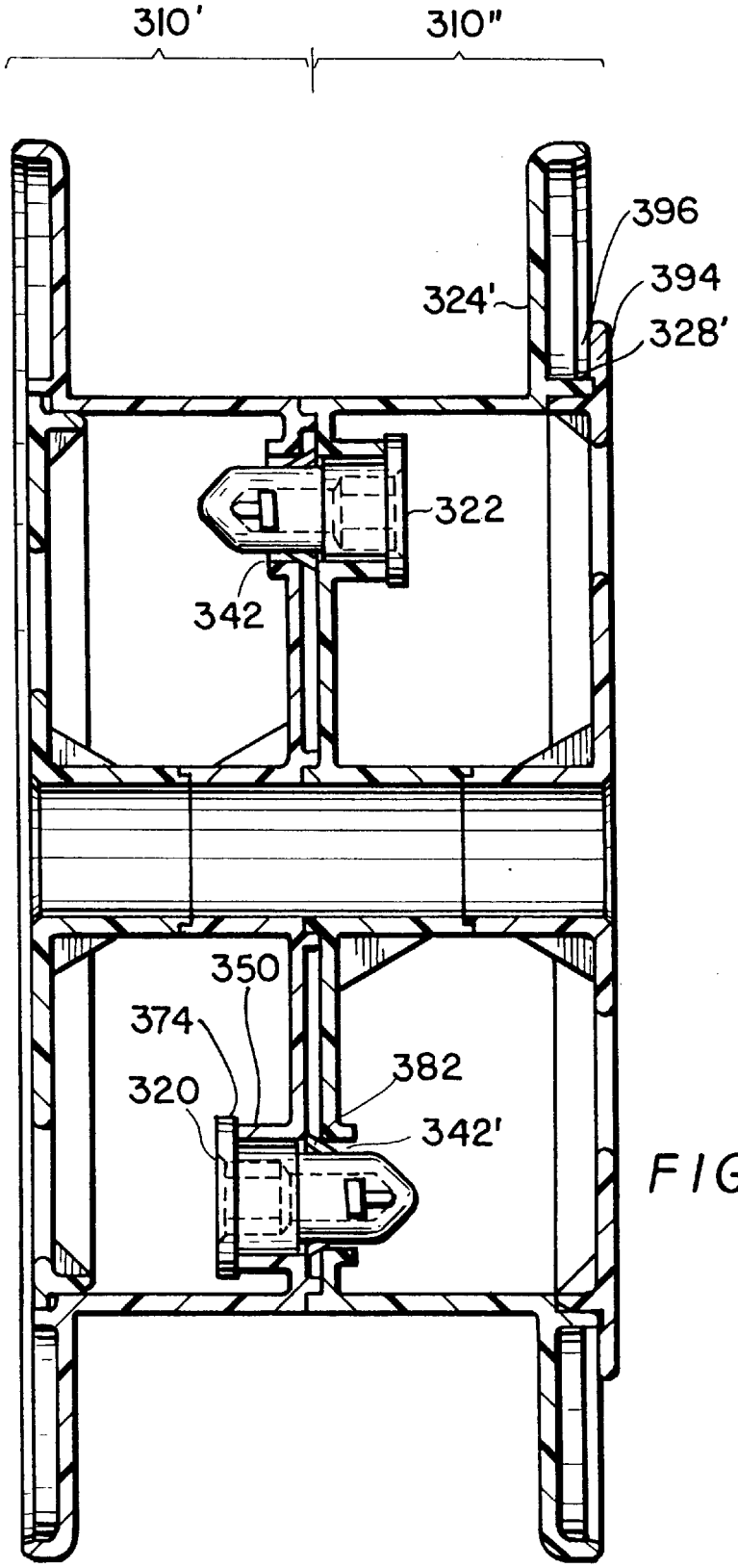
FIG. 23 shows a side-sectional view of the embodiment of FIG. 20 assembled.

The spool 310 is assembled by inserting cap 316 into cup shaped member 312 so that annular wall 362 fits radially inwardly of wall 338 and portion 367 fits into hub 338, as shown in FIG. 23. Cap 318 is fit similarly into cup-shaped member 314. In this manner two substantially identical spool halves 310', 310" are formed. The two spool halves are then secured to each other by using plugs 320, 322. More specifically the two spool halves 310', 310" are positioned so that circular hole 340 on half 310' is positioned opposite oval hole 342' and vice versa.

Prior to securing the two halves together a plug 320 is inserted through hole 366 of the cap 316 into hole 340 until its shoulder 374 abuts wall 350. As the plug is inserted into hole 340, its fingers 382 are bent radially inwardly by the inner surface of wall 350. The plug 320 is dimensioned so that when shoulder 374 reaches wall 350, fingers 382 are past the hole 340 so that they snap outwardly to engage an edge of hole 340 as shown in FIG. 23. As a result the plug 320 is captured by spool half 310'. Plug 322 is similarly captured by spool half 310".

After the two halves 310', 310" are positioned so that holes 340 oppose holes 342' as described above, they are advanced axially toward each other until plug 320 is fully seated in oval hole 342 with the T-shaped bosses 384 passing through the narrow ends of hole 342'. In this position, knob 371 is disposed in depression 352 of wall 350. Similarly plug 322 is fully seated in hole 342. Other plugs may be inserted between the halves as well if desired. The plugs are then rotated clockwise, for example by using an allen wrench in holes 376. The plugs can he rotated until knob 371 snaps over stop 354 in depression 352. As each plug is turned, camming surfaces 386 on bosses 384 ride on the edge 346 of walls 344 thereby pressing the spool halves 310', 310" together. Turning the plugs the other way unlocks the spool halves.

Figure 24:
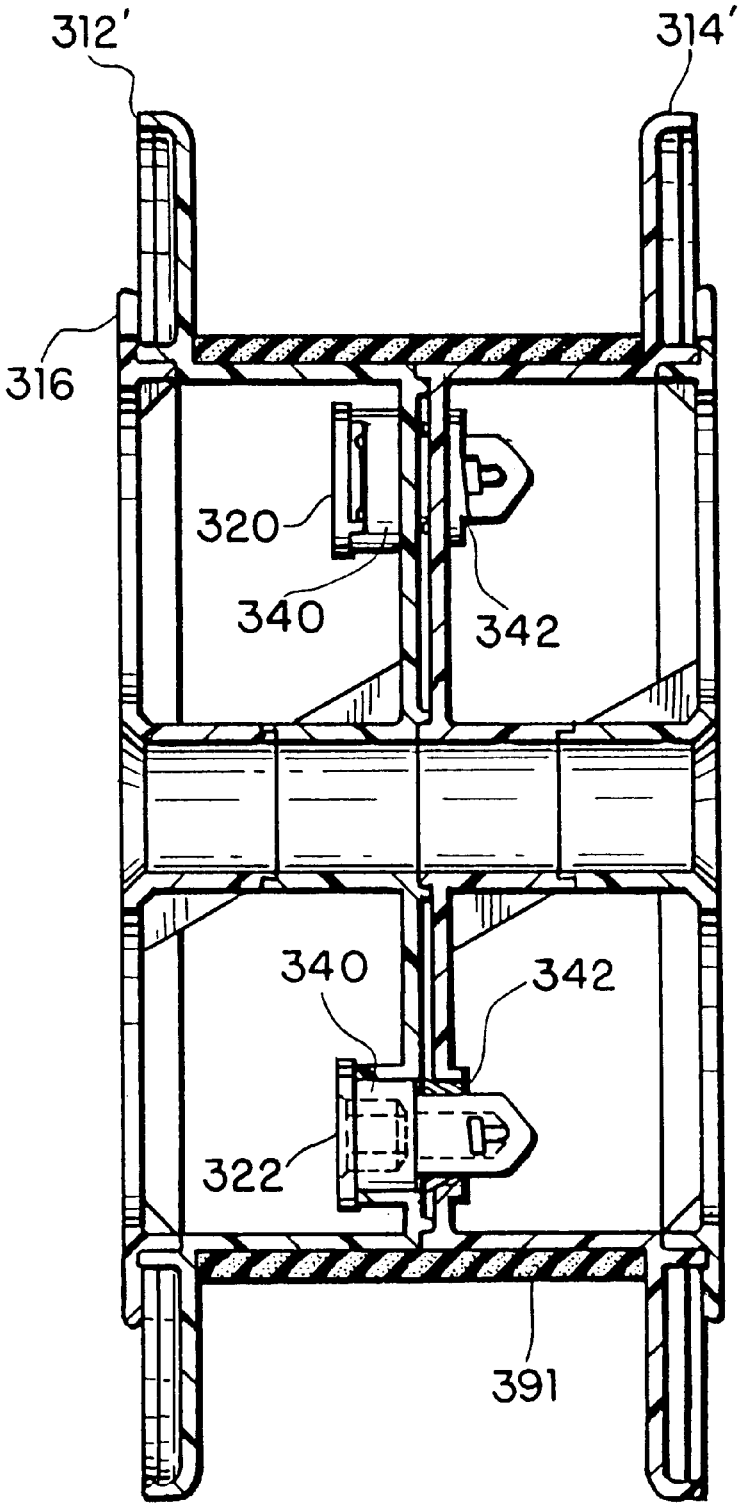
FIG. 24 shows a side sectional view of a fourth embodiment of the invention.
Figure 25:
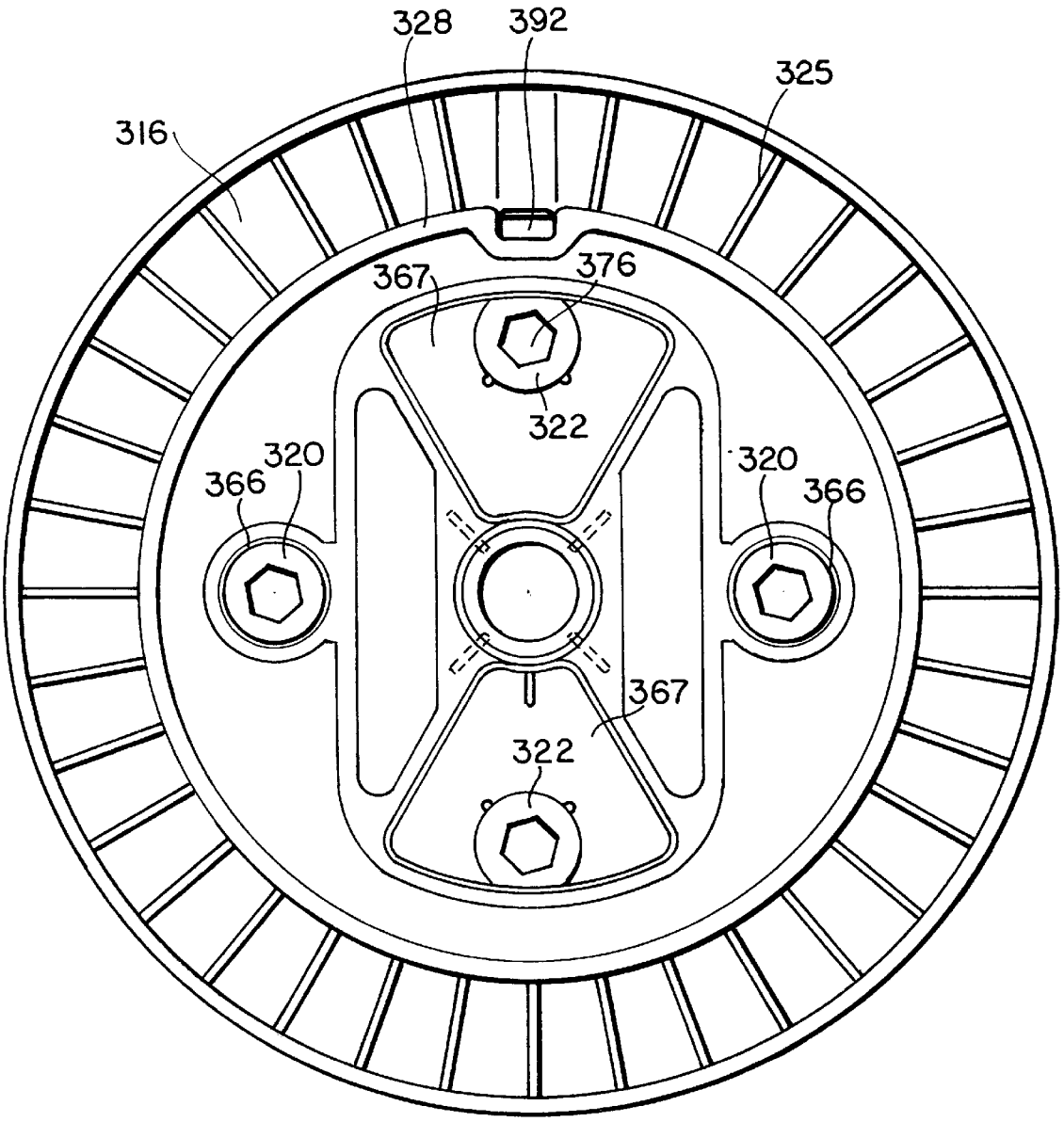
FIG. 25 shows an end view of the embodiment of FIG. 24.
Figure 26:
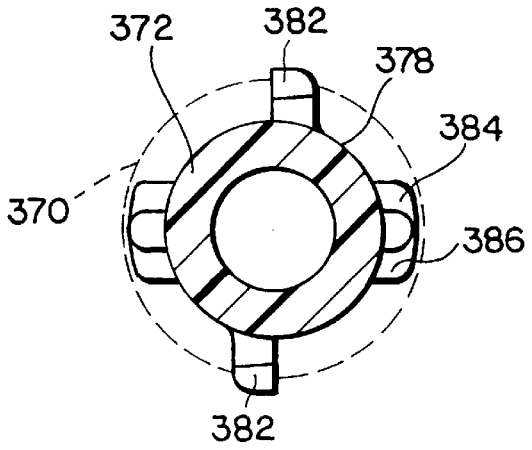
FIG. 26 shows a sectional view of aplug used in the embodiments of FIGS. 20–25.

In the embodiment of FIGS. 20–23, the two cup shaped members 312, 314 can be made to be substantially the same except as noted. The embodiment shown in FIGS. 24 and 25 is identical to the embodiment of FIGS. 20–23 except that the two cup shaped members 312' is provided only with circular holes 340 and cup shaped member 314' is provided only with oval holes 342. In this embodiment plugs 320, 322 are inserted through the same cap 316 while in the previous embodiment plug 320 is inserted through cap 316 while plug 322 is inserted from the other side of the spool through cap 318.

The embodiments of FIGS. 20–26 are used in the same manner as the embodiments described above. After the two spool halves are secured to each other with a resilient sleeve 391 disposed thereon for protection (FIG. 24), an optical fiber other filamentary material is wound on the sleeve. The beginning or end of the spool can be threaded through a hole 392 in cap 316 (or a similar hole in cap 318 , not shown) and wound on lip.328. At least one of the caps such as cap 318 may be formed with an annular lip or auxiliary flange 394. This lip cooperates with wall 324' and lip 328 to define a u-shaped space to insure that the fiber on lip 328' does not slip off. The two half spools can be separated at will by disengaging plugs 320, 322.

Obviously numerous modifications can be made to this invention without departing from its scope as defined in the appended claims.

What is claimed is:

1. A spool for producing, holding and transporting fiber optic media, the spool comprising:

a first member and a second member, said first member and said second member each respectively comprising an inner sleeve, an outer cylindrical wall disposed concentrically about said sleeve, an inner end wall extending from said inner sleeve to said outer cylindrical wall and forming a respective coplanar surface wherein said first member abuts said second member, and an outer end wall formed parallel to said inner end wall and engaging axially outer ends of said outer cylindrical wall, said outer end wall including an annular flange extending radially outward from said outer cylindrical wall;

a cylindrical sleeve of resilient material removably disposed about said outer cylindrical wall of said first member and said second member;

a first cap and a second cap for respectively engaging interior radial portions of said first member and said second member, said first cap and said second cap being substantially parallel with said respective annular flanges;

interlocking means for selectively interlocking said inner end walls of said first member and said second member to define a winding space between said outer end walls of said first member and said second member for holding the fiber optic media, and for disengaging and separating said members to allow at least one portion of the fiber optic media to be removed from the spool, said interlocking means including removable plugs including cam elements for urging said first and second members toward each other when inserted into said interlocking means.

2. The spool of claim 1 wherein at least one of said first member and said second member is formed with a secondary winding surface extending axially away from a corresponding annular flange.

3. The spool of claim 2 wherein said secondary winding surface is bounded between said corresponding annular flange and an auxiliary flange provided on a corresponding cap and axially spaced parallel from said corresponding annular flange.

4. The spool of claim 3 wherein said corresponding annular flange is formed with slots connecting said secondary winding surface to said winding space.

* * * * *

UNITED STATES PATENT AND TRADEMARK OFFICE

CERTIFICATE OF CORRECTION

PATENT NO. : 5,908,172

DATED : June 1, 1999

INVENTOR(S) : Pierro et al.

It is certified that error appears in the above-identified patent and that said Letters Patent is hereby corrected as shown below:

On cover page of patent please change "[75] Inventors: Steven William Pierro, North Chatham; Ronald Tracy Trefzger, Malden Bridge; Leland Hubert Boyles, Oneida; James Richard Wilkinson, East Greenbush; Victor Joseph Desrosiers, Kinderhook; Robert Vincent Fazio, Valatie, all of N.Y." to read

–[75] Inventors: Steven William Pierro, North Chatham; Ronald Tracy Trefzger, Malden Bridge; Leland Hubert Boyles, Oneida; James Richard Wilkinson, East Greenbush; Victor Joseph Desrosiers, Kinderhook; Robert Vincent Fazio, Valatie; Santo Pino, Valatie, all of N.Y.–

Signed and Sealed this

Fifth Day of October, 1999

*Attest:*

*Attesting Officer*

Q. TODD DICKINSON

*Acting Commissioner of Patents and Trademarks*